United States Patent [19]

Kamejima et al.

[11] 4,429,541

[45] Feb. 7, 1984

[54] APPARATUS FOR CONTROLLING OPERATION OF REFRIGERATOR

[75] Inventors: Kohji Kamejima; Yozo Hibino; Junichi Ooizumi, all of Ibaraki; Hideki Tanaka, Kudamatsu; Morio Tamura, Ibaraki, all of Japan

[73] Assignee: Hitachi, Ltd., Tokyo, Japan

[21] Appl. No.: 343,859

[22] Filed: Jan. 29, 1982

[30] Foreign Application Priority Data

Feb. 2, 1981 [JP] Japan ..... 56-12900

[51] Int. Cl.[3] ..... F25D 17/02; F25B 15/00; F24F 3/00

[52] U.S. Cl. ..... 62/201; 62/148; 62/185; 236/1 B; 165/22

[58] Field of Search ..... 236/1 E, 1 B, 7 A, 1 EA, 236/9 A; 165/22; 62/201, 229, 148, 185

[56] References Cited

U.S. PATENT DOCUMENTS 3,482,623 12/1969 Betz ..... 165/22

4,192,455 3/1980 Rasmussen et al. ..... 236/1 B 4,262,491 4/1981 Chorey et al. ..... 62/201

*Primary Examiner*—Albert J. Makay

*Assistant Examiner*—Harry Tanner

*Attorney, Agent, or Firm*—Antonelli, Terry & Wands

[57] ABSTRACT

A method of controlling the operation of a refrigerator of a type having a capacity control mechanism adapted to control the capacity of the refrigerator in such a manner as to make the temperature of the cold water supplied to an air conditioner coincide with a predetermined set temperature of cold water. The apparatus is adapted to vary the set temperature of the cold water in accordance with the level of the load imposed on the air conditioner, and to determine the difference of the new set temperature of the cold water with the actually measured temperature of the cold water. The apparatus effects the control of the capacity control mechanism of the refrigerator such that the above-mentioned difference of the temperature is nullified. In consequence, the efficiency of the refrigerator during partial-load operation is remarkably improved.

8 Claims, 3 Drawing Figures

APPARATUS FOR CONTROLLING OPERATION OF REFRIGERATOR

BACKGROUND OF THE INVENTION

The present invention relates to an apparatus for controlling the operation of a refrigerator and, more particularly, to an apparatus for controlling the operation of a refrigerator incorporated in an air conditioning system installed in a building or the like.

In the air conditioning systems installed in a building or the like, the temperature of the cold water cooled by the refrigerator is determined from the view point of the capacity of the installation. Namely, the capacities of the water pump, blower and other devices, as well as the heat transfer area of the heat exchanger, can be reduced as the difference of temperature between the cold water cooled by the refrigerator and the high temperature in the store or room is increased. Thus, the set temperature of the cold water should be selected to be the lower limit afforded by the refrigerator, in order to minimize the installation cost.

In the conventional air conditioning systems, the refrigerator is operated such that the cold water outlet temperature or the cold water inlet temperature always coincides with the above-mentioned set temperature. Such a method of operating refrigerator is shown, for example, at page 80 in "ABSORPTION REFRIGERATOR AND ITS APPLICATION", published from Association of Refrigeration of Japan (corporation). According to this operation method, the temperature difference between the cold water and the high-temperature source is maintained constant irrespective of the refrigeration load. Therefore, when the refrigeration load is reduced to a level below the rated load, i.e., during partial load operation, the heat through the heat exchanger is reduced to conform with the refrigeration load, by reducing the flow rate of the water or air by controlling the operation of the water pump or blower, or by changing the heat transfer area of reducing the number of heat exchangers taking part in the operation.

From a view point of the efficiency of the system as a whole, it is desirable that the temperature of the cold water is raised during the partial load operation. Thus, the above-explained conventional method in which the temperature of the cold water is maintained constant is not preferred from this point of view. Namely, in this conventional method, the coefficient of performance is lowered because the temperature of the cold water is maintained unnecessarily low, so that the refrigerator has to consume greater energy for a given refrigeration load.

Thus, in the conventional operation method, the running cost of the air conditioning system is increased due to the low coefficient of performance of the refrigerator.

SUMMARY OF THE INVENTION

Accordingly, an object of the invention is to provide an apparatus for controlling the operation of a refrigerator capable of operating the refrigerator at a reduced running cost.

Another object of the invention is to provide an apparatus for controlling the operation of a refrigerator which can reduce the running cost of an air conditioning system to which the refrigerator is connected.

To these ends, according to the invention, there is provided an apparatus for controlling the operation of a refrigerator in which the previously set temperature of the cold water in the refrigerator is changed in response to a change in the refrigeration load, within such a range that the air conditioning system can cope with the load demanded.

Other objects, features and advantages of the invention will become clear from the following description of a preferred embodiment of the invention taken in conjunction with the accompanying drawings.

DESCRIPTION OF THE PREFERRED EMBODIMENT

Figure 1:
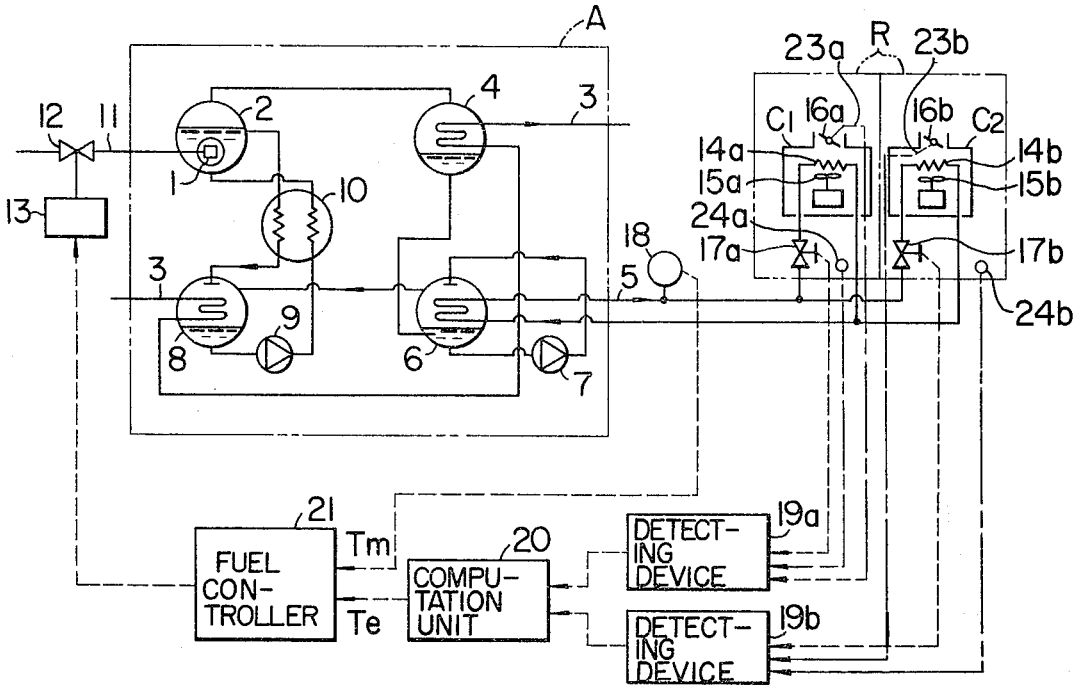
FIG. 1 is a block diagram of an absorption refrigerator to which an example of the controlling apparatus of the invention is applied.

Referring first to FIG. 1 showing an absorption refrigerator incorporating a controlling apparatus in accordance with the invention, the absorption refrigerator A has a generator 2 in which a thin solution is heated by a heat source such as a burner 1 to become a refrigerant vapor, a condenser 4 having cooling water pipes 3 so as to effect a heat exchange between the refrigerant vapor generated by the generator 2 and the cooling water flowing in the cooling water pipe 3 thereby to condense the refrigerant, an evaporator 6 in which the condensed refrigerant is evaporated by the latent heat derived from water flowing in a cold water pipe 5 thereby to produce cold water (cold heat medium), a refrigerant circulation pump 7 annexed to the evaporator 6, an absorber 8 in which the refrigerant vapor generated in the evaporator 6 is absorbed by a concentrated solution induced from the generator 2 while being cooled by the cooling water flowing in the cooling water pipes 3, a solution pump 9 adapted to deliver the diluted solution formed in the absorber 8 into the generator 2, and a heat exchanger 10 in which a heat exchange is performed between the hot concentrated solution returned from the generator 2 to the absorber and the cold diluted solution supplied from the absorber 8 to the generator 2.

In this embodiment, an oil burning type heater for producing heat by burning an oil is used as the heat source 1. An oil supply pipe 11 for supplying the oil is connected to the heat source 1. The oil supply pipe 11 is provided with a valve 12 for adjusting the rate of supply of the oil. The valve 12 constitutes a capacity control mechanism of the absorption refrigerator A. The opening degree of the valve 12 is controlled by a valve actuating device 13.

The cold water pipe 5 is connected to the heat exchangers 14*a*, 14*b* of air conditioners $C_1$ and $C_2$ installed, for example, in a room R of a building. The air conditioners $C_1$ and $C_2$ are provided with blowers 15*a*, 15*b* and dampers 16*a*, 16*b* for adjusting the flow rates of air, in addition to the aforementioned heat exchangers 14*a* and 14*b*. The cold water pipe 5 is provided with water flow rate adjusting valves 17*a* and 17*b*. Furthermore, the cold water pipe 5 has a cold water temperature detector 18 adapted to detect the temperature Tm of the cold water.

In this embodiment, the opening degrees of the water flow rate adjusting valves 17*a*, 17*b* are detected as the index of the load applied to the air conditioners. Overload detecting devices 19*a*, 19*b* are connected to the adjusting valves 17*a*, 17*b*. The overload detecting devices 19*a*, 19*b* are adapted to produce overload signals $S_1$, $S_2$ of "1" level when the water adjusting valves 17*a* and 17*b* are opened fully. When the water flow rate adjusting valves 17*a*, 17*b* take other positions, the overload detecting devices 19*a*, 19*b* produce overload signals $S_1$, $S_2$ of "0" level. A cold water temperature computation unit 20 is adapted to make an arithmetic operation of the set temperature Te of the cold water, in response to the overload signals $S_1$, $S_2$. The set temperature Te of cold water calculated by the cold water temperature computation unit 20 is delivered to a fuel supply rate controller 21 which receives also a signal representing the measured temperature Tm of the cold water detected by the cold water temperature detector 18. The fuel supply rate controller 21 operates to control the opening degree of the fuel adjusting valve 12 through the valve actuating device 13.

Figure 2:
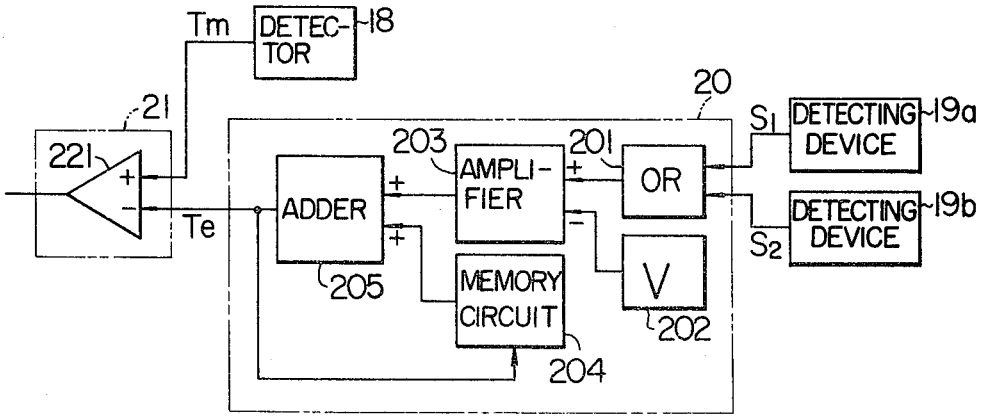
FIG. 2 is a circuit diagram of a practical embodiment of the controlling apparatus in accordance with an embodiment of the invention.

FIG. 2 shows a practical example of the circuit of the controlling apparatus of the invention, in which the same reference numerals are used to denote the same parts or members as those in FIG. 1.

The cold water temperature computation unit includes an OR circuit 201 adapted to pick up the overload signal $S_1$, $S_2$ coming from the overload detecting devices 19*a*, 19*b*, a voltage generator 202 adapted to produce a voltage signal corresponding to a predetermined temperature variant $\Delta T$ which is 0.5° C. for example, an amplifier 203 adapted to produce a voltage signal corresponding to a predetermined absolute value of the temperature variant $\pm\Delta T$ in accordance with the signal from the OR circuit 201, a memory circuit 204 adapted to produce a voltage signal corresponding to a predetermined set value Teo of the cold water temperature and to memorize a voltage signal corresponding to the calculated set value Te of the cold water temperature, and an adder 205 adapted to add the voltage signals corresponding to the predetermined temperature variant and the set value of the cold water temperature.

The fuel supply rate controller 21 is constituted by a comparator 211 adapted to produce a voltage signal corresponding to the difference between the measured temperature Tm of the cold water derived from the cold water temperature detector 18 and the set value Te of the cold water produced by the cold water temperature computation unit 20.

Figure 3:
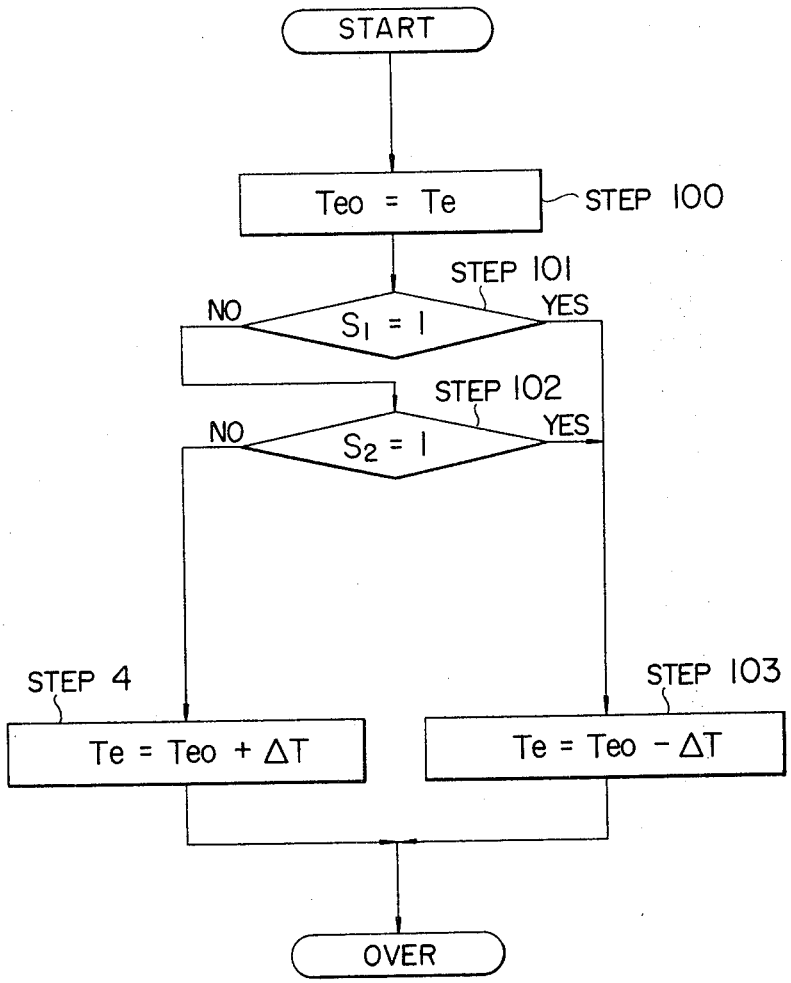
FIG. 3 is a flow chart of an arithmetic operation performed by a water temperature computation unit incorporated in the controlling apparatus of the invention.

An explanation will be made hereinunder as to the process of operation performed by the cold water temperature computation unit 20 with reference to the flow chart shown in FIG. 3.

The instant cold water temperature Teo is memorized as the set value Te of the cold water temperature (step 100). Thereafter, a judgement is made as to whether the overload signal $S_1$ coming from the overload detecting device 19*a* takes the "1" level or not (step 101). Then, when the overload signal $S_1$ takes the "1" level, a temperature which is lower than the instant set value Teo of cold water temperature by a predetermined temperature variant $\Delta T$ which is, for example, 0.5° C. is memorized as the set value Te of the cold water temperature (step 103). Referring back to the step 101, if the overload signal $S_1$ takes the "0" level, a judgement is made as to whether the overload signal $S_2$ takes the "1" level or not (step 102). Then, the operation of the step 103 is performed if the overload signal $S_2$ takes the "1" level. However, if the overload signal $S_2$ takes the "0" level, a temperature which is higher than the instant set value Teo of the cold water temperature by the predetermined variant $\Delta T$ is set as the set temperature Te of the cold water (step 140). Thus, the cold water temperature computation unit 20 produces the set value Te of the cold water temperature in response to the change in the load demand in the air conditioners $C_1$, $C_2$. In consequence, the cold water temperature unit takes the set value Te which is the highest within such a range as not to cause an overload in the air conditioners.

The refrigerator controlling apparatus of the described embodiment operates in a manner explained hereinunder.

When the water flow rate adjusting valve 17*a* adjacent to the air conditioners $C_1$, $C_2$ is opened fully, the overload detecting device 19*a* delivers the overload signal $S_1$ of the level "1" to the cold water temperature computation unit 20. In consequence, the cold water temperature computation unit 20 performs a calculation to lower the set temperature Te from the instant one Teo by the predetermined temperature variant $\Delta T$ following up the flow chart shown in FIG. 3, and this temperature is memorized as the set value Te of the cold water temperature. This set value is also delivered to the fuel supply rate controller 21. On the other hand, when the overload signal $S_1$ takes the level "0", the cold water temperature computation unit 20 picks up the overload signal $S_2$ from the overload detecting device 19*b* and effects a similar arithmetic operation to calculate the set value Te of the cold water temperature. The signal representing the set value Te calculated by the cold water temperature computation unit 20 is delivered to the fuel supply rate controller 21. The controller 21 then effects the control of the opening degree of fuel supply rate adjusting valve 12 through the valve actuating mechanism 13 in such a manner as to nullify the measured temperature Tm of cold water derived from the cold water temperature detector 18 and the set value Te of the cold water delivered by the cold water temperature operation unit 21. In consequence, the set value Te of the cold water temperature can take the maximum value within such a range as not to cause the overload in the air conditioners $C_1$, $C_2$. It is thus possible to minimize the input to the refrigerator for a given load demand in the air conditioners.

Although the invention has been described through a specific embodiment applied to an oil burning type absorption refrigerator, this is not exclusive and the invention can be equally applied to other types of refrigerators, such as refrigerators employing various type of compressors. It is also possible to use the opening degrees of the blower dampers 1i6*a*, 16*b* or the air temperature in the room as the index of the load demanded by the air conditioners, although in the described embodiment the opening degrees of the water flow rate adjusting valves 17*a*, 17*b* of the air conditioners as the index for discriminating the state of overload of the air conditioners. When the opening degrees of the damper is used as the index, overload signals of level "1" are produced by damper position detectors 23*a* and 23*b* when the dampers 16*a*, 16*b* are fully opened, while overload signals of level "0" are produced when the dampers 16*a*, 16*b* are opened only partially. In the case where the room temperature is used as the index, an overload signal of level "1" is produced when the room temperature as measured by a temperature detector 24*a* or 24*b* exceeds a predetermined temperature, whereas, when the room temperature is below the predetermined temperature, the "0" level.

In the described embodiment, the fuel supply rate adjusting valve 12 is used as the control object controlled in accordance with the difference between the set value Te of the cold water temperature and the measured cold water temperature Tm. This, however, is not exclusive and the equivalent effect is obtained by controlling the flow rate of cooling water supplied to the refrigerator or the flow rate of the vapor in the refrigerator. Also, when a turbo refrigerator is used, the opening degree of the inlet vanes, which constitute one of the capacity controllers of the turbo refrigerator, may be used as the control object. Similarly, in the case where the refrigerator has a compressor of the reciprocating type or rotary type, the same effect is achieved by controlling the running speed of the compressor.

As will be understood from the foregoing description, according to the invention, it is possible to vary the set temperature of the cold water within such a range as not to cause an overload of the air conditioner, so that the power input to the refrigerator can be minimized for a given refrigeration load thereby to remarkably lower the running cost of the refrigeration or air conditioning system.

What is claimed is:

1. In a refrigerator having a capacity control mechanism adapted to control the capacity of said refrigerator in such a manner that the temperature of cold water supplied to a plurality of individual controllable air conditioners coincides with a predetermined set temperature value, an apparatus for controlling the operation of said refrigerator comprising:

a plurality of overload detecting devices, each of which is adapted to detect the loading condition of a respective one of said air conditioners, which in turn constitutes the load on said refrigerator, and to produce an overload signal that is indicative of whether or not the respective one of said air conditioners is overloaded;

a cold water temperature computation unit adapted to calculate the set temperature value of the cold water in accordance with the overload signals coming from said overload detecting devices and to produce a signal corresponding to the calculated set temperature value;

a cold water temperature detector adapted to detect the temperature of said cold water; and a control means adapted to determine the difference between the measured cold water temperature derived from said cold water temperature detector and said set temperature value of the cold water temperature derived from said cold water temperature computation unit and to control the capacity control mechanism of said refrigerator in accordance with said difference.

2. An apparatus for controlling the operation of refrigerator as claimed in claim 1, wherein each of said overload detecting devices is adapted to detect the amount of a state in a respective one of said air conditioners which relates to the load on the respective air conditioner and to determine whether said respective air conditioner is overloaded in accordance with the detected amount.

3. An apparatus for controlling the operation of refrigerator as claimed in claim 2, wherein the state detected is water flow rate and wherein each of said overload detecting devices is connected to a water flow rate adjusting valve of a respective air conditioner, and is adapted to produce said overload signal which takes a "1" level when said valve is fully opened and a "0" level when said valve takes an opening degree other than the full opening, respectively.

4. An apparatus for controlling the operation of refrigerator as claimed in claim 2, wherein the state detected is damper position and each of said overload detecting devices is connected to a damper of a blower of a respective air conditioner, and is adapted to produce said overload signal which takes a "1" level when said damper is fully opened and a "0" level when said damper takes an opening degree other than full opening, respectively.

5. An apparatus for controlling the operation of refrigerator as claimed in any one of claims 2 to 4, wherein said cold water temperature computation unit which calculates and outputs said set temperature value signal is adapted to raise the set temperature value of said cold water temperature by a predetermined temperature variant when said overload signals indicate that none of said air conditioners are overloaded and to lower said set temperature value by a predetermined temperature variant when said overload signals indicate that at least one of said air conditioners is overloaded.

6. An apparatus for controlling the operation of refrigerator as claimed in claim 1, wherein each of said overload detecting devices is adapted to detect the amount of a state which directly relates to the load on a respective one of said air conditioners and to determine whether the respective air conditioner is overloaded in accordance with the detected amount.

7. An apparatus for controlling the operation of refrigerator as claimed in claim 6, wherein the state detected is room temperature and each of said overload detecting devices is connected to a temperature detector adapted to detect the temperature in a room in which a respective air conditioner is installed, and is adapted to produce said overload signal which takes a "1" level and a "0" level, respectively, when the room temperature detected by said temperature detector exceeds a predetermined room temperature and when said room temperature does not exceed said predetermined room temperature.

8. An apparatus for controlling the operation of refrigerator as claimed in claim 7, wherein said cold water temperature computation unit for calculating the set temperature value of cold water is adapted to change the calculated set temperature signal by raising the set temperature value of said cold water by a predetermined temperature variant when all of said overload signals take a "0" level and by lowering said set temperature value by a predetermined temperature variant when at least one of said overload signals takes a "1" level.

* * * * *